US011773648B2

(12) United States Patent
Huang

(10) Patent No.: US 11,773,648 B2
(45) Date of Patent: Oct. 3, 2023

(54) CELLULAR SHADE

(71) Applicant: TAICANG KINGFU PLASTIC MANUFACTURE CO., LTD., Taicang (CN)

(72) Inventor: Szu-Chang Huang, Fusing Township, Changhua County (TW)

(73) Assignee: TAICANG KINGFU PLASTIC MANUFACTURE CO., LTD., Taicang (CN)

( * ) Notice: Subject to any disclaimer, the term of this patent is extended or adjusted under 35 U.S.C. 154(b) by 108 days.

(21) Appl. No.: 17/469,588

(22) Filed: Sep. 8, 2021

(65) Prior Publication Data

US 2022/0081968 A1 Mar. 17, 2022

(30) Foreign Application Priority Data

Sep. 14, 2020 (CN) ..... 202022005378.4

(51) Int. Cl.
*E06B 9/262* (2006.01)
*E06B 9/38* (2006.01)

(52) U.S. Cl.
CPC ..... *E06B 9/262* (2013.01); *E06B 9/38* (2013.01); *E06B 2009/2627* (2013.01)

(58) Field of Classification Search
CPC .... E09B 9/262; E09B 2009/2627; E09B 9/38; E09B 9/388; E09B 2009/2441; E09B 9/264; E09B 9/323; E09B 9/382; A47H 1/13; A47H 1/14
USPC ..... 248/683, 467, 206.5, 309.4
See application file for complete search history.

(56) References Cited

U.S. PATENT DOCUMENTS 2,521,363 A * 9/1950 Gregory ..... E06B 9/386 160/173 R
2,687,171 A * 8/1954 Rosenbaum ..... E06B 9/388 160/173 R
2002/0079067 A1* 6/2002 McCarty ..... E06B 9/323 160/178.1 R
2006/0021718 A1* 2/2006 Franssen ..... E06B 9/266 160/178.1 R (Continued)

FOREIGN PATENT DOCUMENTS

WO WO-2014057366 A1 * 4/2014 ..... A47H 1/12

*Primary Examiner* — Abe Massad
*Assistant Examiner* — Matthew R. Shepherd
(74) *Attorney, Agent, or Firm* — Hamre, Schumann, Mueller & Larson, P.C.

(57) ABSTRACT

A cellular shade includes a head rail unit, an intermediate rail unit, a bottom rail unit, a blind body and a magnetically attractive unit. The head rail unit includes a head rail and a lower mounting bracket. The intermediate rail unit includes an intermediate rail and an upper mounting bracket. The magnetically attractive unit includes a first housing mounted on the lower mounting bracket, a second housing mounted on the upper mounting bracket, and a magnet mounted on one of the first and second housings. The other one of the first and second housings is magnetically attractive with the magnet. The first housing includes a first positioning member to be retainingly positioned to the lower mounting bracket. The head rail unit and the intermediate rail unit can be firmly secured to each other by means of the magnetically attractive unit so as to prevent light leaking.

8 Claims, 7 Drawing Sheets

(56) References Cited

U.S. PATENT DOCUMENTS

| | | | | |
|---|---|---|---|---|
| 2007/0209765 | A1* | 9/2007 | Lin | E06B 9/30 160/84.04 |
| 2008/0087387 | A1* | 4/2008 | Chen | E06B 9/388 160/173 R |
| 2009/0014133 | A1* | 1/2009 | Lin | E06B 9/262 160/181 |
| 2009/0025888 | A1* | 1/2009 | Brace | E06B 9/388 160/84.05 |
| 2009/0139666 | A1* | 6/2009 | Anderson | E06B 9/303 160/168.1 R |
| 2009/0205789 | A1* | 8/2009 | Watkins | E06B 9/262 29/897 |
| 2012/0312486 | A1* | 12/2012 | Spray | E06B 9/388 24/115 L |
| 2015/0075729 | A1* | 3/2015 | Anderson | E06B 9/322 160/193 |
| 2016/0123074 | A1* | 5/2016 | Anderson | E06B 9/327 160/368.1 |
| 2016/0222721 | A1* | 8/2016 | Rettig | E06B 9/262 |
| 2017/0234062 | A1* | 8/2017 | Schwandt | E06B 9/266 160/40 |

* cited by examiner

CELLULAR SHADE

CROSS-REFERENCE TO RELATED APPLICATION

This application claims priority of Chinese Patent Application No. 202022005378.4, filed on Sep. 14, 2020.

FIELD

The disclosure relates to a window blind, and more particularly to a magnetically attractive cellular shade.

BACKGROUND

A conventional cellular covering or honeycomb shade includes a head rail, a bottom rail, an intermediate rail suspended together with the bottom rail from the head rail, a fabric blind material interconnecting the intermediate rail with the bottom rail, and a pull cord assembly operable to move the intermediate rail relative to the head rail in an up-down direction so as to extend or retract the blind material. The blind material can be lowered or raised from the top down, from the bottom up, or in a manner of the combination thereof to maintain privacy and have light control and a view. One disadvantage with this cellular covering resides in the fact that light leaking occurs because of the clearance between the head rail and the intermediate rail.

SUMMARY

Therefore, an object of the disclosure is to provide a cellular shade that can alleviate light leaking.

According to the disclosure, the cellular shade includes a head rail unit, an intermediate rail unit, a bottom rail unit, a blind body, a control unit and a magnetically attractive unit. The head rail unit includes a head rail which extends in a left-right direction, and a lower mounting bracket which is disposed on the head rail and which extends downwardly from the head rail. The lower mounting bracket has a first base wall. The intermediate rail unit is disposed downwardly of the head rail unit, and includes an intermediate rail which extends in the left-right direction, and an upper mounting bracket which is disposed on the intermediate rail and which extends upwardly from the intermediate rail. The bottom rail unit is disposed downwardly of the intermediate rail unit. The blind body interconnects the intermediate rail unit and the bottom rail unit to be extended and folded in an up-down direction. The control unit is operable to actuate movement of the intermediate rail unit relative to the head rail unit in the up-down direction. The magnetically attractive unit includes a first housing which is mounted on the lower mounting bracket, a second housing which is mounted on the upper mounting bracket and which faces the first housing in the up-down direction, and a magnet which is mounted on one of the first and second housings. The other one of the first and second housings has a magnetically attractive portion which is magnetically attractive with the magnet. The first housing includes a first support member and a first positioning member which has a first extending portion that extends from the first support member toward the first base wall, and a first abutting portion that extends from the first extending portion to abut against the first base wall so as to retainingly position the first housing to the lower mounting bracket.

With the first positioning member easily positioning the first support member to the lower mounting bracket, the magnetically attractive unit is simple in structure. The head rail unit and the intermediate rail unit can be firmly secured to each other by means of the magnetically attractive unit so as to prevent light leaking.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
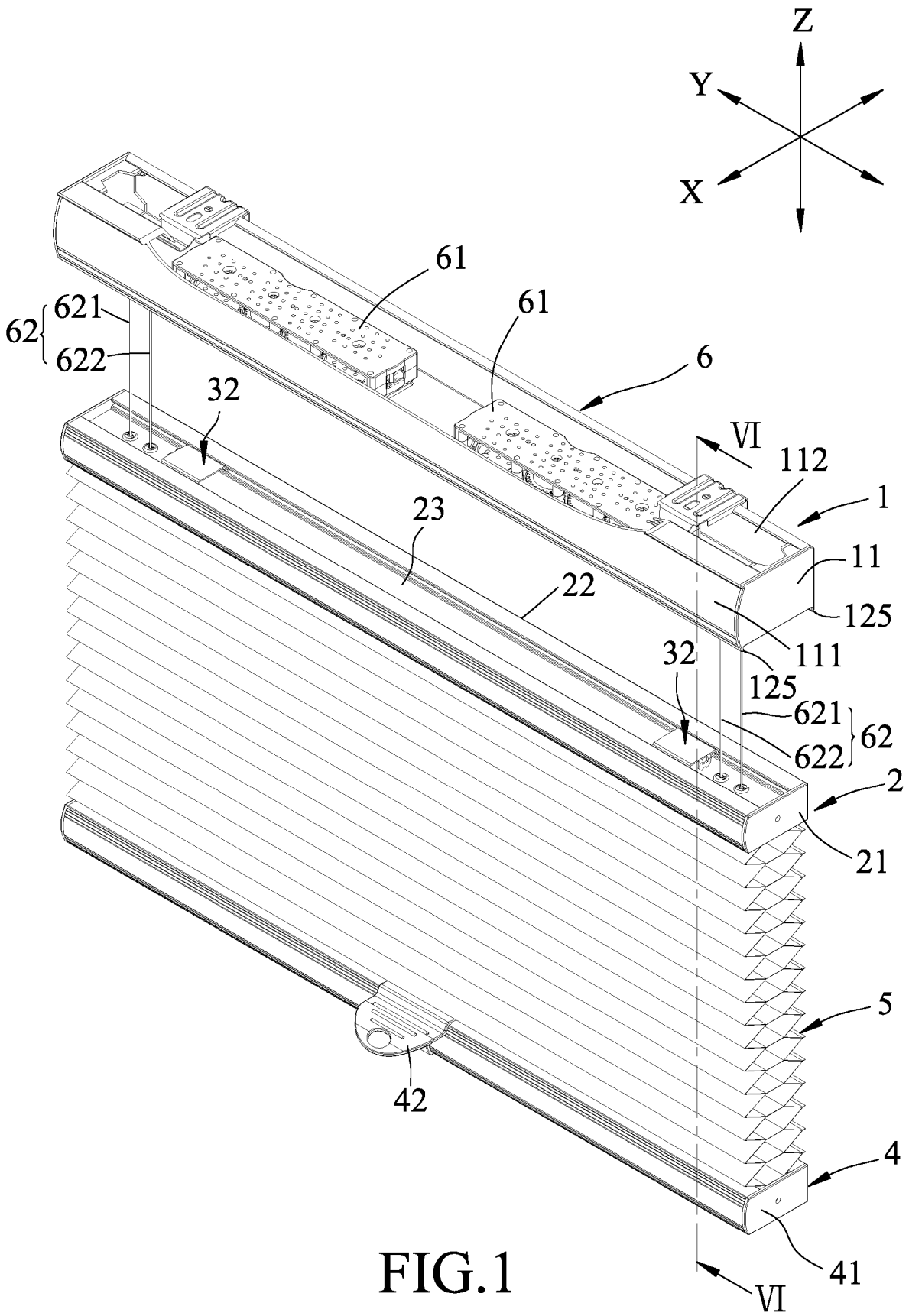
FIG. 1 is a fragmentary perspective view illustrating an embodiment of a cellular shade according to the disclosure.

The relative positional terms used in the following descriptions, such as "front-rear direction (X)", "left-right direction (Y)", and "up-down direction (Z)", are based on the orientation shown in each figure and the normal usage orientation.

Referring to FIGS. 1, 2, 3 and 6, an embodiment of a cellular shade according to the disclosure includes a head rail unit 1, an intermediate rail unit 2, two magnetically attractive units 3, a bottom rail unit 4, a blind body 5 and a control unit 6.

The head rail unit 1 includes a head rail 11 which extends in a left-right direction (Y), and a lower mounting bracket 12 which is disposed on the head rail 11 and which extends downwardly from the head rail 11. The head rail 11 has a front surrounding wall 111 and a rear surrounding wall 112 opposite to each other in a front-rear direction (X). The lower mounting bracket 12 has a first base wall 121 interconnecting the front and rear surrounding walls 111, 112 and disposed horizontally to have front and rear sides in the front-rear direction (X), a first front wall 122 extending downwardly from the front side of the first base wall 121, a first rear wall 123 extending downwardly from the rear side of the first base wall 121, two first extending walls 124 respectively extending from lower ends of the first front and rear walls 122, 123 in the front-rear direction (X) and toward each other, and front and rear covering walls 125 extend downwardly from the first front wall 122 and the first rear wall 123, respectively. Only one of the front and rear covering walls 125 may be formed on the first front wall 122 or the first rear wall 123, alternatively. The first base wall 121, the first front wall 122, the first rear wall 123 and the first extending walls 124 cooperatively define a first receiving space 13 thereamong. The first receiving space 13 has a first front space region 131 bordered by the first base wall 121, the first front wall 122 and a corresponding one of the first extending walls 124, a first rear space region 132 bordered by the first base wall 121, the first rear wall 123 and another corresponding one of the first extending walls 124, and a first opening 133 bordered by the two first extending walls 124 and opened downwardly.

The intermediate rail unit 2 is disposed downwardly of the head rail unit 1, and includes an intermediate rail 21 which extends in the left-right direction (Y), and an upper mounting bracket 22 which is disposed on the intermediate rail 21 and which extends upwardly from the intermediate rail 21 toward the lower mounting bracket 12. The upper mounting bracket 22 has a second base wall 221 disposed horizontally to have front and rear sides in the front-rear direction (X), a second front wall 222 extending upwardly from the front side of the second base wall 221, a second rear wall 223 extending upwardly from the rear side of the second base wall 221, and two second extending walls 224 respectively extending from upper ends of the second front and rear walls 222, 223 in the front-rear direction (X) and toward each other. The second base wall 221, the second front wall 222, the second rear wall 223 and the second extending walls 224 cooperatively define a second receiving space 23 thereamong.

The second base wall 221 has two extending wall portions 225 respectively extending from the second front and rear walls 222, 223 in the front-rear direction (X), two turning wall portions 226 respectively extending from the extending wall portions 225 downwardly, and a base wall portion 227 interconnecting the turning wall portions 226. The second receiving space 23 has a second front space region 231 bordered by the second front wall 222, a corresponding one of the second extending walls 224 and a corresponding one of the extending wall portions 225, a second rear space region 232 bordered by the second rear wall 223, another corresponding one of the second extending walls 224 and another corresponding one of the extending wall portions 225, and a second opening 233 bordered by the two second extending walls 224 and opened upwardly.

Figure 2:
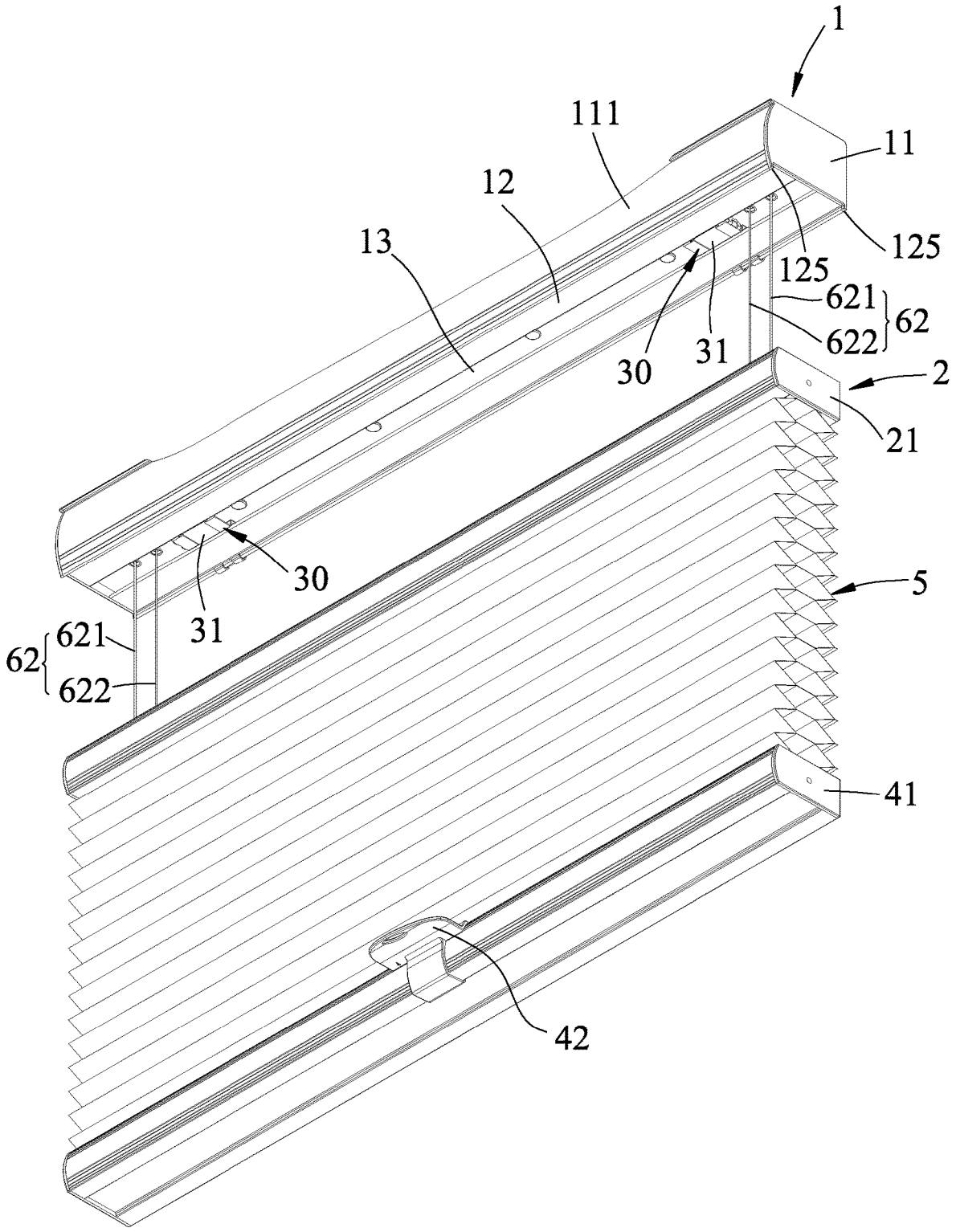
FIG. 2 is a fragmentary perspective view of the embodiment taken from another angle.
Figure 3:
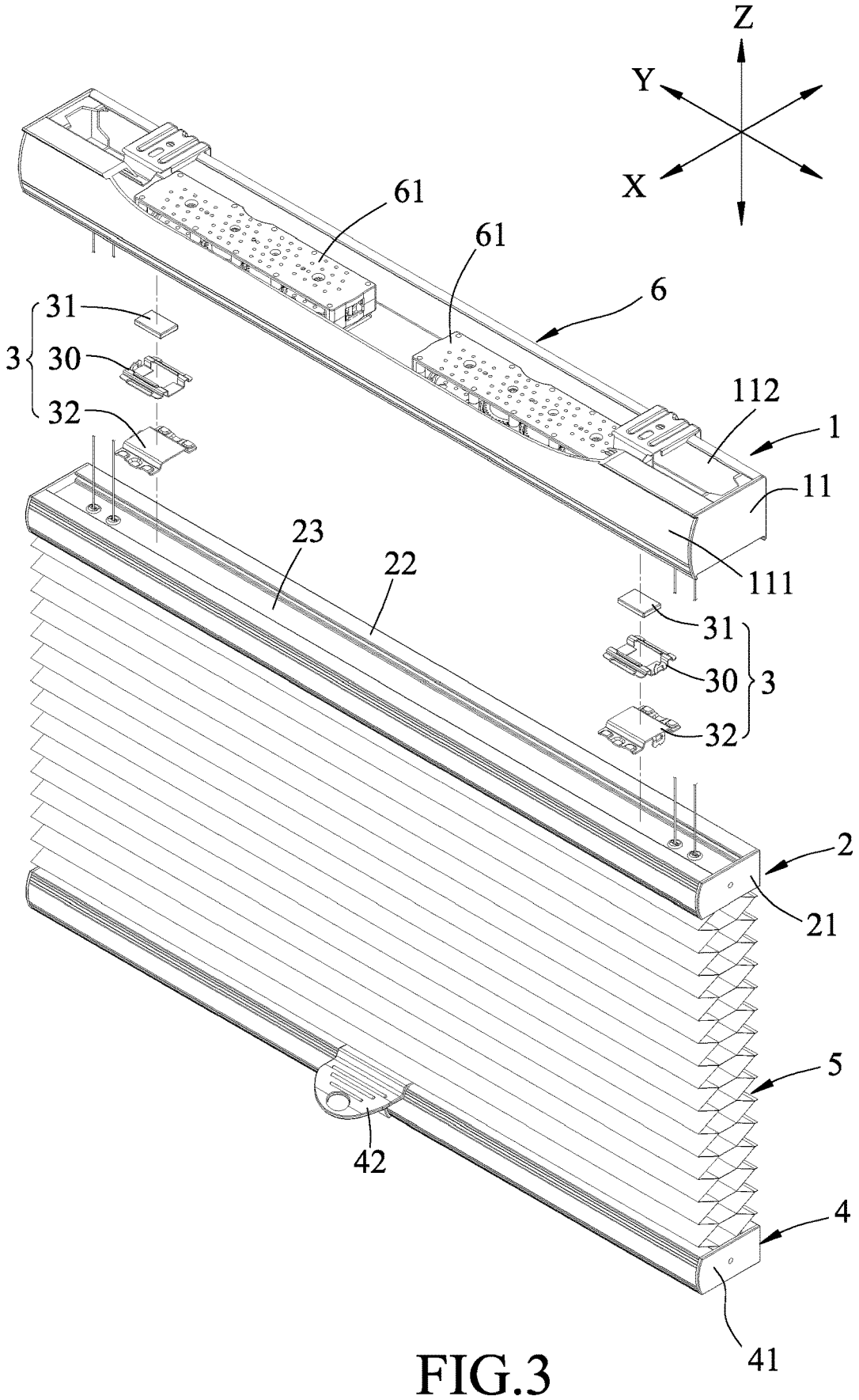
FIG. 3 is a fragmentary, partly exploded perspective view of the embodiment.

With reference to FIGS. 1, 2 and 3, the magnetically attractive units 3 are spaced apart from each other in the left-right direction (Y). Each magnetically attractive unit 3 includes a first housing 30 received in the first receiving space 13, a rectangular magnet 31 mounted on the first housing 30, and a second housing 32 received in the second receiving space 23 and facing the first housing 30 in the up-down direction (Z) to be magnetically attracted with the magnet 31. In this embodiment, both the first housing 30 and the second housing 32 are made from a magnetically attractive material, such as metal. In various embodiments, the second housing 32 may have a magnetically attractive portion made from a magnetically attractive material to be magnetically attracted with the magnet 31. Alternatively, the magnet 31 may be mounted on the second housing 32. Since the two magnetically attractive units 3 are symmetrically disposed relative to the left-right direction (Y), only a right magnetically attractive unit 3 is described in detail.

Figure 4:
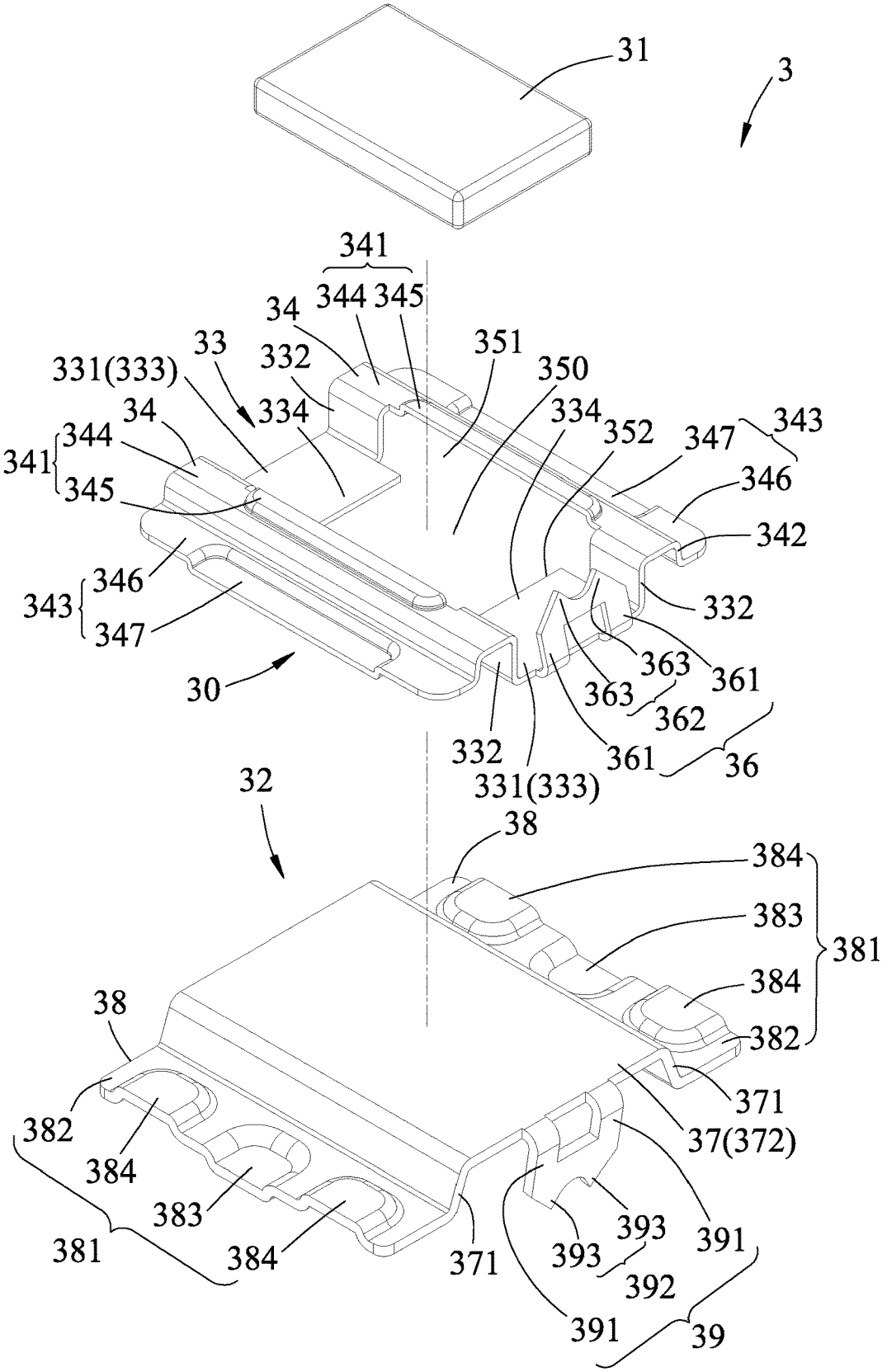
FIG. 4 is an exploded perspective view of a magnetically attractive unit of the embodiment.
Figure 5:
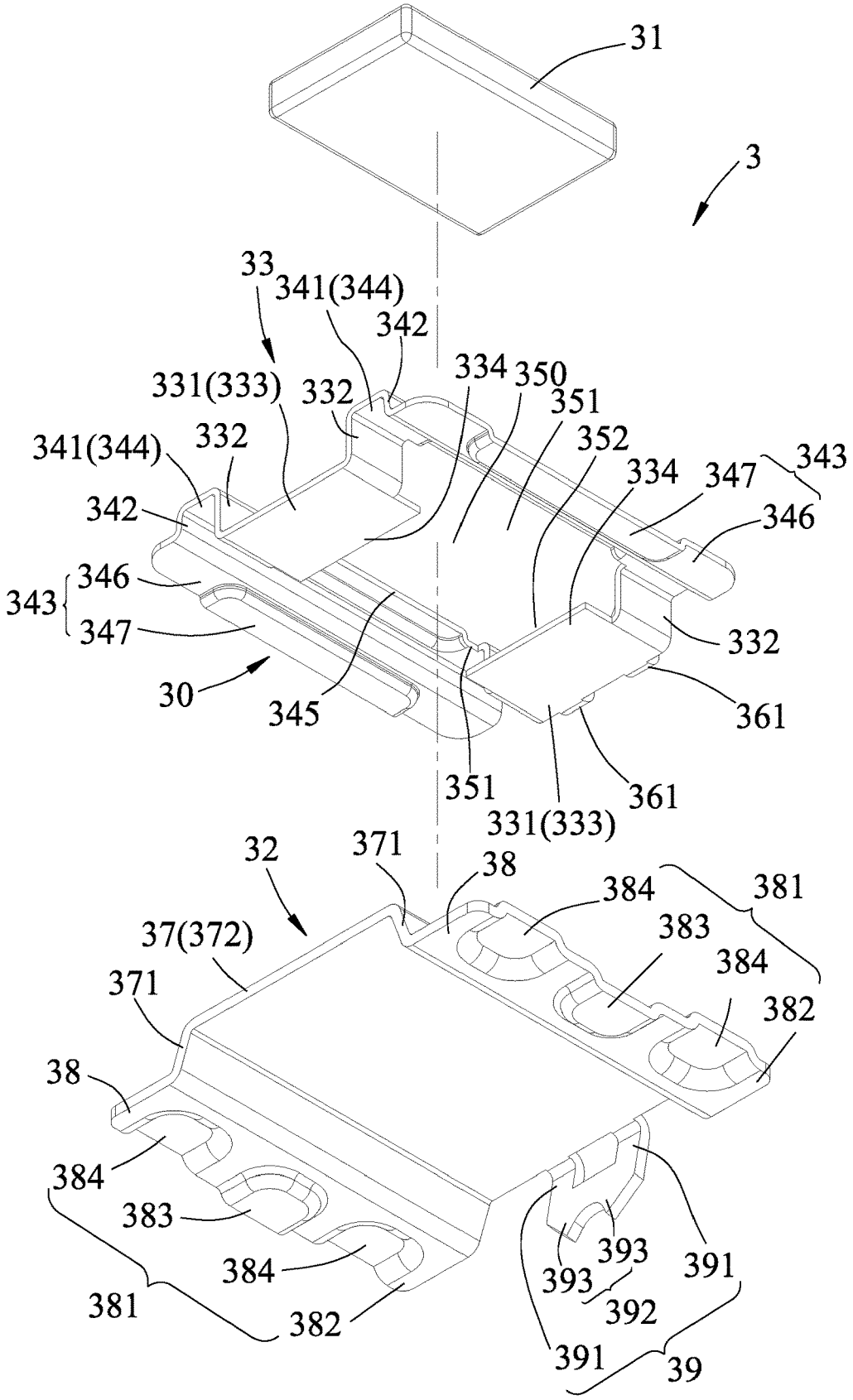
FIG. 5 is an exploded perspective view of the magnetically attractive unit taken from another angle.
Figure 6:
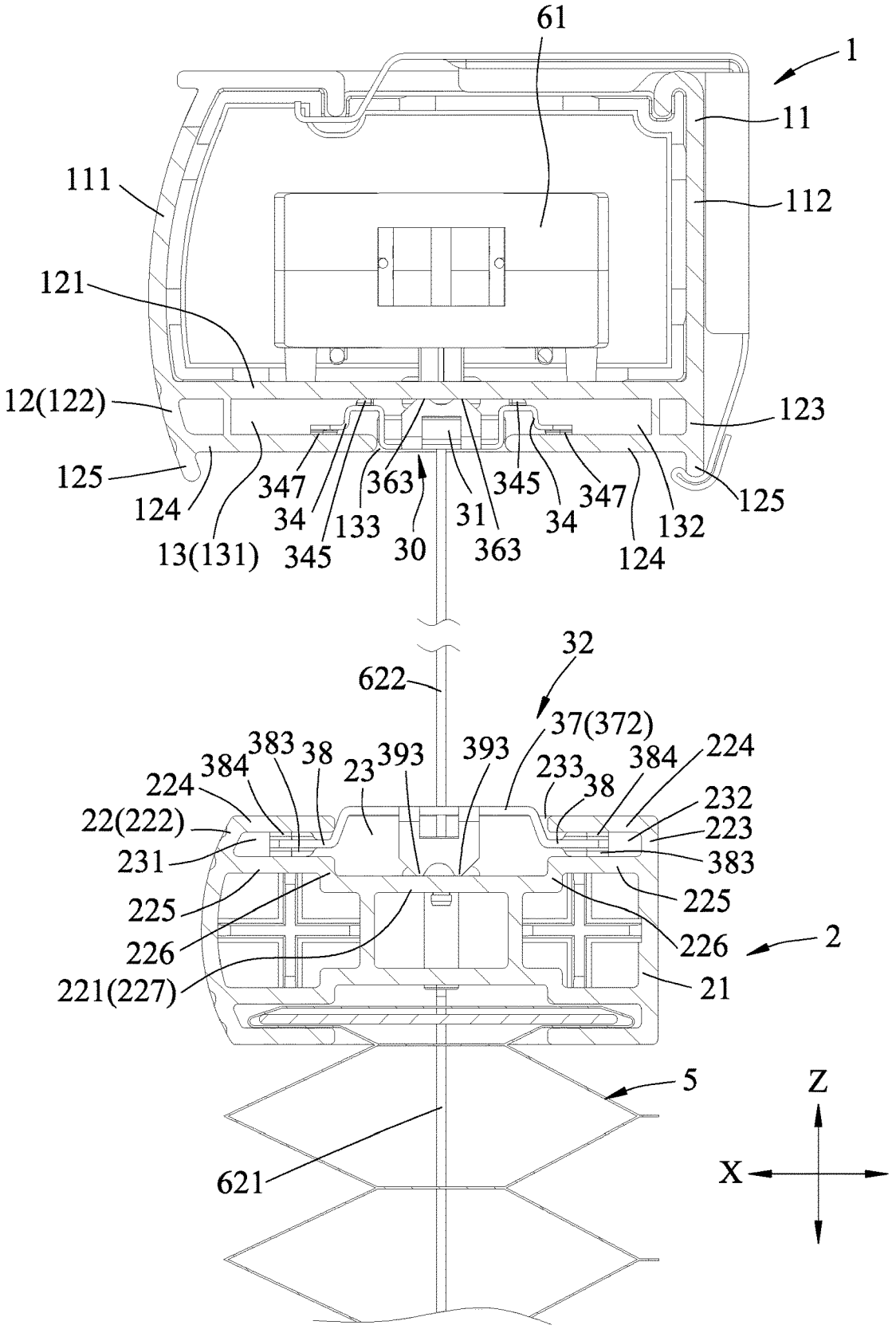
FIG. 6 is a fragmentary, partly sectional view taken from line VI-VI of FIG. 1, illustrating the embodiment in a light transmitting position.

With reference to FIGS. 4, 5 and 6, the first housing 30 includes a first support member 33 which is partly disposed in the first opening 133, two first fit connecting members 34 which extend from the first support member 33 in the front-rear direction (X) and outwardly and which are respectively and fittingly received in the first front and rear space regions 131, 132, and a first positioning member 36 which is disposed on the first support member 33 to retain the first support member 33 to the lower mounting bracket 12.

Each first fit connecting member 34 is integrally formed with and is bent from the first support member 33 to have an upper abutment plate 341 which is disposed horizontally and faces upwardly, a turning plate 342 which extends downwardly from the upper abutment plate 341, and a lower abutment plate 343 which extends horizontally and outwardly from the turning plate 342. The upper abutment plate 341 has an upper plate body 344 and a first upper protruding portion 345 which is punched and projects upwardly from the upper plate body 344 and which abuts against the first base wall 121. The lower abutment plate 343 has a lower plate body 346 and a first lower protruding portion 347 which is punched and projects downwardly from the lower plate body 346 and which abuts against the corresponding first extending wall 124. The first upper protruding portion 345 is in the form of an elongated plate integrally formed at a middle of the upper plate body 344. The first lower protruding portion 347 is in the form of an elongated plate integrally formed at a middle of the lower plate body 346.

The first support member 33 has two U-shaped first support plates 331 which are spaced apart from each other in the left-right direction (Y) and each of which interconnects the upper abutment plates 341 of the first fit connecting members 34. Each first support plate 331 has two first lateral plate portions 332 which are respectively joined with the upper abutment plates 341 of the first fit connecting members 34, a first base plate portion 333 which interconnects the two first lateral plate portions 332 to cooperatively define thereamong an accommodation space 350 for accommodating the magnet 31, and a carrier plate portion 334 which extends from the first base plate portion 333 in the left-right direction (Y) for carrying the magnet 31 thereon. The first support plates 331 and the upper abutment plates 341 cooperatively define two lateral openings 351 at front and rear sides of the accommodation space 350, respectively, and a lower opening 352 in spatial communication with the accommodation space 350 and the lateral openings 351 and facing the second housing 32. The carrier plate portions 334 of the first support plates 331 extend toward each other to border the lower opening 352. The magnet 31 is magnetically attracted with and supported on the carrier plate portions 334, and has front and rear side portions which are respectively inserted into the lateral openings 351. In various embodiments, the magnet 31 may be supported on the first base plate portions 333 of the first support plates 331 and is accommodated in the accommodation space 350 so that the front and rear side portions thereof are not inserted into the lateral openings 351. Alternatively, the magnet 31 may be supported on the first base plate portions 333 and the carrier plate portions 334 such that part of the magnet 31 is accommodated in the accommodation space 350 and part of the magnet 31 is disposed on the first base plate portions 333 to have the front and rear side portions inserted or not inserted into the lateral openings 351.

The first positioning member 36 is connected with a side of the right base plate portion 333 and opposite to the corresponding carrier plate portion 334. The first positioning member 36 has two first extending portions 361 which integrally extend from the base plate portion 333 toward the first base wall 121, and a first abutting portion 362 that extends from the first extending portions 361. The first abutting portion 362 has two first tip ends 363 which abut against the first base wall 121. Through the first upper protruding portions 345 abutting against the first base wall 121, and the first lower protruding portions 347 abutting against the first extending walls 124, the first housing 30 is retainingly received in the first receiving space 13 and restricted from, movement in the up-down direction (Z). Moreover, through the first tip ends 363 abutting against the first base wall 121, a counteracting force is generated to enhance the abutment of the first lower protruding portions 347 against the first extending walls 124 so as to guard the first housing 30 from movement in the left-right direction (Y). Thus, the first housing 30 is retainingly and firmly positioned to the lower mounting bracket 12.

The second housing 32 includes a second support member 37 which is partly disposed in the second opening 233, two second fit connecting members 38 which extend from the second support member 37 in the front-rear direction (X) and which are respectively and fittingly received in the second front and rear space regions 231, 232, and a second positioning member 39 which is disposed on the second support member 37 to retain the second support member 37 to the upper mounting bracket 22.

Each second fit connecting member 38 has an abutting plate 381 which is disposed horizontally and which has lower and upper abutting surfaces that respectively abut against the second base wall 221 and the corresponding second extending wall 224. Specifically, in this embodiment, the abutting plate 381 has an abutting plate body 382, a second lower protruding portion 383 which is punched and projects downwardly from the abutting plate body 382 and which abuts against the corresponding extending wall portion 225 of the second base wall 221, and two second upper protruding portions 384 which are punched and project upwardly from the abutting plate body 382 and which abut against the corresponding second extending wall 224. The second upper protruding portions 384 are formed at left and right sides of the second lower protruding portion 383. The second upper protruding portions 384 and the second lower protruding portion 383 are integrally formed with the abutting plate body 382.

The second support member 37 is of an inverted U-shaped plate, and has two second lateral plate portions 371 which are respectively and integrally joined with the abutting plates 381 of the second fit connecting members 38, and a second base plate portion 372 which interconnects the two second lateral plate portions 371 and which serves as a magnetically attractive portion to be magnetically attracted with the magnet 31.

The second positioning member 39 has two second extending portions 391 which integrally extend from a right side of the second support member 37 toward the upper mounting bracket 22 and which are spaced apart from each other, and a second abutting portion 392 which extends from the second extending portions 391. The second abutting portion 392 has two second tip ends 393 which abut against the base wall portion 227 of the second base wall 221. Through the second upper protruding portions 384 abutting against the second extending walls 224, and the second lower protruding portions 383 abutting against the extending wall portions 225 of the second base wall 221, the second housing 32 is retainingly received in the second receiving space 23 and restricted from movement in the up-down direction (Z). Moreover, through the second tip ends 393 abutting against the base wall portion 227 of the second base wall 221, a counteracting force is generated to enhance the abutment of the second upper protruding portions 384 against the second extending walls 224 so as to guard the second housing 32 from movement in the left-right direction (Y). Thus, the second housing 32 is retainingly and firmly positioned to the upper mounting bracket 22.

Figure 7:
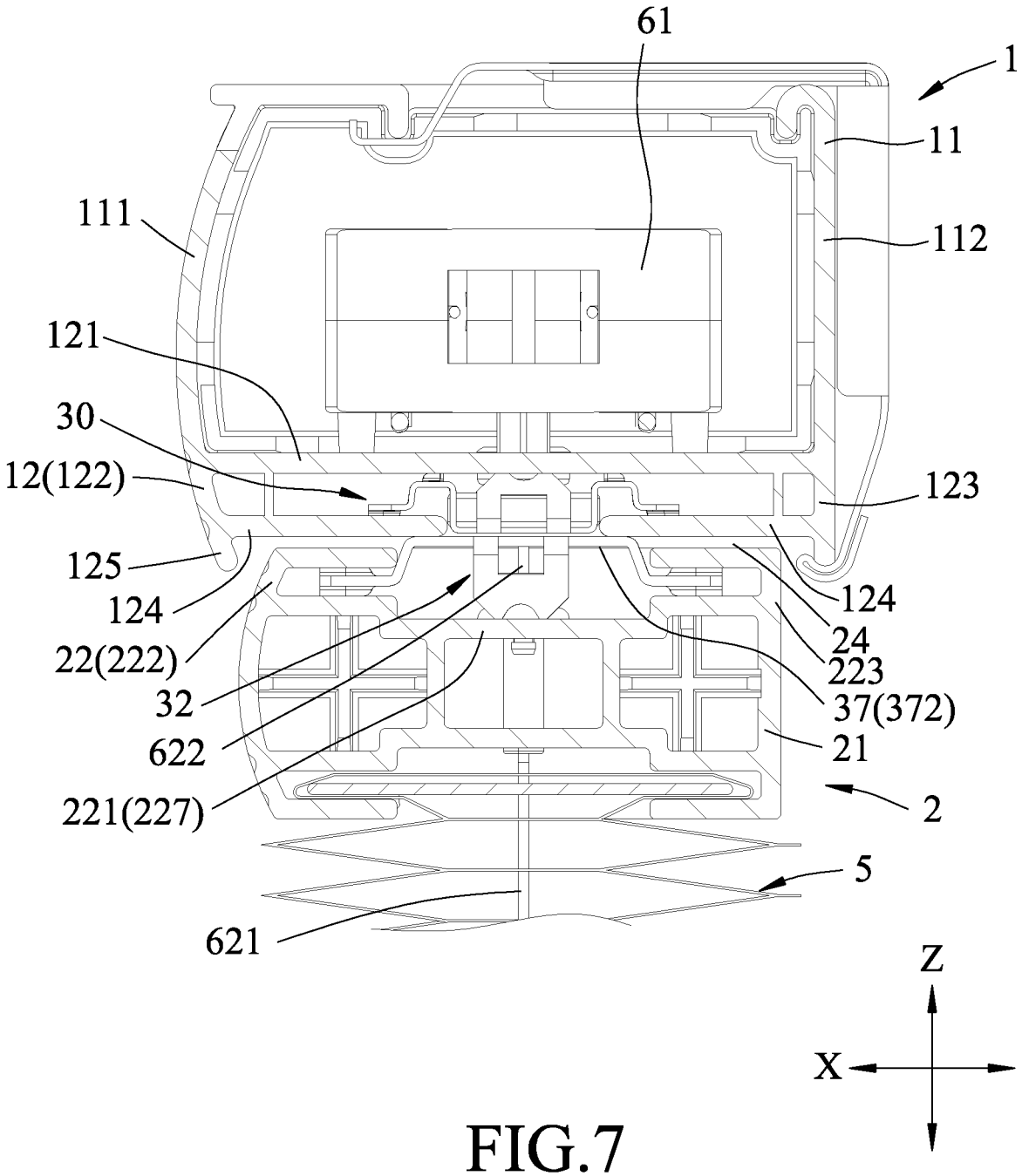
FIG. 7 is a fragmentary, partly sectional view similar to FIG. 6, illustrating the embodiment in a blocking position.

With reference to FIGS. 1, 6 and 7, the bottom rail unit 4 is disposed downwardly of the intermediate rail unit 2, and includes a bottom rail 41 extending in the left-right direction (Y), and a handle 42 disposed on a front side of the bottom rail 41.

The blind body 5 interconnects the intermediate rail 21 and the bottom rail unit 41 to be extended and folded in the up-down direction (Z). In this embodiment, the blind body 5 has a honeycomb cell structure.

The control unit 6 is operable to actuate movement of the intermediate rail unit 2 relative to the head rail unit 1 in the up-down direction (Z), and includes two transmitting assemblies 61 disposed in the head rail 11 and spaced apart from each other in the left-right direction (Y), and two pull cord assemblies 62 respectively and operatively connected with the transmitting assemblies 61. Each pull cord assembly 62 has a bottom rail pull cord 621 passing downwardly through the intermediate rail unit 2 and the blind body and disposed in the bottom rail unit 4, and an intermediate rail pull cord 622 passing downwardly through the base wall portion 227 and disposed inwardly of the bottom rail pull cord 621. Since the pull cord assemblies 62 and the transmitting assemblies 61 are of a hitherto known type, a detailed description thereof is dispensed with herein. In this embodiment, the transmitting assemblies 61 are of a power-driven motor mechanism. In various embodiments, the transmitting assemblies 61 may be of other type of driving mechanisms.

Through the transmitting assemblies 61 respectively actuating the pull cord assemblies 62, the pull cord assemblies 62 respectively drive the movements of the intermediate rail unit 2 and the bottom rail unit 4 relative to the head rail unit 1 in the up-down direction (Z). The movements of the intermediate rail unit 2 and the bottom rail unit 4 can be operated in a manual manner.

The intermediate rail unit 2 is movable relative to the head rail unit 1 in the up-down direction (Z) between a light transmitting position and a blocking position. In the light transmitting position, the upper mounting bracket 22 is remote from the lower mounting bracket 12 to permit passage of light and vision. In the blocking position, the upper mounting bracket 22 is proximate to the lower mounting bracket 12, the second base plate portion 372 of the second support member 37 is magnetically attracted with the magnet 31, the second base plate portion 372 abuts against the first extending walls 124, and the front and rear covering walls 125 cover a clearance 24 between the lower mounting bracket 12 and the upper mounting bracket 22 in the front-rear direction (X). The user can operate the transmitting assemblies 61 or manually operate the handle 42 to move the bottom rail unit 4 in the up-down direction (Z) so as to extend the blind body 5. In various embodiments, with a variety of dimensions of the first opening 133, the second opening 233, the first support member 33 and the second support member 37, in the blocking position, the second base plate portion 372 of the second support member 37 may abut against the first support plates 331, and the second extending walls 224 may abut against the first extending walls 124.

As illustrated, with the first positioning member 36 easily positioning the first support member 33 to the lower mounting bracket 12, and with the second positioning member 39 easily positioning the second support member 37 to the upper mounting bracket 22, the magnetically attractive unit 3 is simple in structure. The head rail unit 1 and the intermediate rail unit 2 can be easily and rapidly secured to or separated from each other by means of the magnetically attractive unit 3. With the front and rear covering walls 125 covering the clearance 24 between the head rail unit 1 and the intermediate rail unit 2 in the blocking position, the passage of light and vision can be blocked efficiently.

Undesired light leaking due to the weight of the intermediate rail unit 2 or the motion of the bottom rail unit 4 by a user is prevented.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A cellular shade comprising:

a head rail unit including a head rail which extends in a left-right direction, and a lower mounting bracket disposed on said head rail and extending downwardly from said head rail, said lower mounting bracket having a first base wall disposed horizontally to have front and rear sides in a front-rear direction;

an intermediate rail unit disposed downwardly of said head rail unit and including an intermediate rail which extends in the left-right direction, and an upper mounting bracket which is disposed on said intermediate rail and which extends upwardly from said intermediate rail;

a bottom rail unit disposed downwardly of said intermediate rail unit;

a blind body interconnecting said intermediate rail unit and said bottom rail unit to be extended and folded in an up-down direction;

a control unit operable to actuate movement of said intermediate rail unit relative to said head rail unit in the up-down direction; and a magnetically attractive unit including a first housing which is mounted on said lower mounting bracket, a second housing which is mounted on said upper mounting bracket and which faces said first housing in the up-down direction, and a magnet which is mounted on one of said first and second housings, the other one of said first and second housings having a magnetically attractive portion which is magnetically attractive with said magnet, said first housing including a first support member and a first positioning member which has a first extending portion that extends from said first support member toward said first base wall, and a first abutting portion that extends from said first extending portion to abut against said first base wall so as to retainingly position said first housing to said lower mounting bracket, wherein said lower mounting bracket further has a first front wall extending downwardly from said front side of said first base wall, a first rear wall extending downwardly from said rear side of said first base wall, and two first extending walls respectively extending from lower ends of said first front and rear walls in the front-rear direction and toward each other, said first base wall, said first front wall, said first rear wall and said first extending walls cooperatively defining thereamong a first receiving space for receiving said first housing, said first receiving space having a first front space region bordered by said first base wall, said first front wall and a corresponding one of said first extending walls, a first rear space region bordered by said first base wall, said first rear wall and another corresponding one of said first extending walls, and a first opening bordered by said two first extending walls and opened downwardly, said first support member being partly disposed in said first opening, said magnet being mounted on said first support member, said first housing further including two first fit connecting members which extend from said first support member in the front-rear direction and which are respectively and fittingly received in said first front and rear space regions, and wherein each of said first fit connecting members is bent from said first support member to have an upper abutment plate which is disposed horizontally and faces upwardly, a turning plate which extends downwardly from said upper abutment plate, and a lower abutment plate which extends horizontally from said turning plate, said first support member having two U-shaped first support plates which are spaced apart from each other in the left-right direction and each of which interconnects said upper abutment plates of said first fit connecting members, each of said first support plates having two first lateral plate portions which are respectively joined with said upper abutment plates of said first fit connecting members, and a first base plate portion which interconnects said two first lateral plate portions to cooperatively define thereamong an accommodation space for accommodating said magnet, two lateral openings at front and rear sides of said accommodation space, respectively, and a lower opening in spatial communication with said accommodation space and said lateral openings and facing said second housing.

2. The cellular shade as claimed in claim 1, wherein said first support plates further have carrier plate portions which respectively extend from said first base plate portions toward each other in the left-right direction for carrying said magnet thereon and bordering said lower opening, said magnet being supported on said carrier plate portions and having front and rear side portions which are respectively inserted into said lateral openings.

3. The cellular shade as claimed in claim 1, wherein said upper abutment plate has an upper plate body and a first upper protruding portion which is punched and projects upwardly from said upper plate body and which abuts against said first base wall, said lower abutment plate having a lower plate body and a first lower protruding portion which is punched and projects downwardly from said lower plate body and which abuts against said corresponding first extending wall.

4. The cellular shade as claimed in claim 1, wherein said upper mounting bracket has a second base wall, said second housing includes a second support member and a second positioning member which has a second extending portion that extends from said second support member toward said upper mounting bracket, and a second abutting portion that extends from said second extending portion to abut against said second base wall so as to retainingly position said second housing to said second base wall.

5. The cellular shade as claimed in claim 4, wherein said second base wall is disposed horizontally to have front and rear sides in a front-rear direction, said upper mounting bracket further having a second front wall extending upwardly from said front side of said second base wall, a second rear wall extending upwardly from said rear side of said second base wall, and two second extending walls respectively extending from upper ends of said second front and rear walls in the front-rear direction and toward each other, said second base wall, said second front wall, said second rear wall and said second extending walls cooperatively defining thereamong a second receiving space for receiving said second housing, said second receiving space having a second front space region bordered by said second base wall, said second front wall and a corresponding one of said second extending walls, a second rear space region bordered by said second base wall, said second rear wall and another corresponding one of said second extending walls, and a second opening bordered by said two second extending walls and opened upwardly, said second housing including a second support member which is partly disposed in said second opening, and two second fit connecting members which extend from said second support member in the front-rear direction and which are respectively and fittingly received in said second front and rear space regions.

6. The cellular shade as claimed in claim 5, wherein each of said second fit connecting members has an abutting plate which is disposed horizontally and which has lower and upper abutting surfaces that respectively abut against said second base wall and said corresponding second extending wall, said second support member being of an inverted U-shaped plate, and having two second lateral plate portions which are respectively joined with said abutting plates of said second fit connecting members, and a second base plate portion which interconnects said two second lateral plate portions and which serves as said magnetically attractive portion to be magnetically attracted with said magnet.

7. The cellular shade as claimed in claim 6, wherein said abutting plate of each of said second fit connecting members has an abutting plate body, a second lower protruding portion which is punched and projects downwardly from said abutting plate body and which abuts against said second base wall, and a second upper protruding portion which is punched and projects upwardly from said abutting plate body and which abuts against said corresponding second extending wall.

8. The cellular shade as claimed in claim 1, wherein said lower mounting bracket further has front and rear covering walls which extend downwardly from said first front wall and said first rear wall, respectively, so as to cover a clearance between said lower mounting bracket and said upper mounting bracket in the front-rear direction.

* * * * *